US008128374B2

(12) United States Patent
Boeck

(10) Patent No.: US 8,128,374 B2
(45) Date of Patent: Mar. 6, 2012

(54) SECURING ELEMENT FOR FASTENING ROTOR BLADES

(75) Inventor: Alexander Boeck, Kottgeisering (DE)

(73) Assignee: MTU Aero Engines GmbH, Munich (DE)

( * ) Notice: Subject to any disclaimer, the term of this patent is extended or adjusted under 35 U.S.C. 154(b) by 1070 days.

(21) Appl. No.: 11/989,552

(22) PCT Filed: Jul. 19, 2006

(86) PCT No.: PCT/DE2006/001246

§ 371 (c)(1),
(2), (4) Date: Jan. 28, 2008

(87) PCT Pub. No.: WO2007/014543

PCT Pub. Date: Feb. 8, 2007

(65) Prior Publication Data

US 2009/0092497 A1 Apr. 9, 2009

(30) Foreign Application Priority Data

Jul. 30, 2005 (DE) ..... 10 2005 035 901

(51) Int. Cl.
*F01D 5/32* (2006.01)

(52) U.S. Cl. ..... 416/221; 29/889.21

(58) Field of Classification Search ..... 416/221, 416/220 R, 219 R, 220 A, 219 A, 204 A, 416/248; 29/889.21
See application file for complete search history.

(56) References Cited

U.S. PATENT DOCUMENTS

| | | | | |
|---|---|---|---|---|
| 3,045,329 | A * | 7/1962 | Carli et al. | 416/221 |
| 4,247,257 | A * | 1/1981 | Benoist et al. | 416/221 |
| 5,211,407 | A | 5/1993 | Glynn et al. | 277/192 |
| 5,662,458 | A * | 9/1997 | Owen | 416/220 R |

FOREIGN PATENT DOCUMENTS

| | | |
|---|---|---|
| EP | 0 609 979 | 8/1994 |
| EP | 0 761 930 | 3/1997 |
| GB | 2 016 092 | 9/1979 |

* cited by examiner

*Primary Examiner* — Richard Edgar
(74) *Attorney, Agent, or Firm* — Davidson, Davidson & Kappel, LLC

(57) ABSTRACT

A securing element for securing the position of moving blades in slots, running at least mainly in the axial direction, of a rotor parent body of a turbomachine rotor is described, comprising a plate-shaped parent body, wherein the parent body has an approximately central recess which is formed between two end sections of the parent body and defines a center section, running between the two end sections, of the parent body, wherein the two end sections have bearing surfaces running parallel to one another.

8 Claims, 3 Drawing Sheets

SECURING ELEMENT FOR FASTENING ROTOR BLADES

The present invention relates to a securing element for securing rotor blades in position in grooves of a rotor base body of a turbine engine rotor. The present invention also relates to a method for mounting a securing element on a turbine engine rotor, in particular on a gas turbine rotor, and to a turbine engine rotor.

BACKGROUND

Rotors of a turbine engine, such as gas turbine rotors, have a rotor base body, as well as a plurality of rotor blades that rotate therewith. The rotor blades can either be an integral part of the rotor base body or be anchored via blade roots in one or a plurality of grooves of the rotor base body. Rotors having integral blading are referred to as blisks or blings, depending on whether a rotor base body is disk-shaped or ring-shaped. In the case of rotors where the rotor blades are anchored via blade roots in a groove, one differentiates between rotors whose blade roots are fastened in what are generally known as axial grooves of the rotor base body and those whose blade roots are fastened in what is generally known as a circumferential groove of the same. The present invention is directed to a rotor of a turbine engine, in particular a gas turbine rotor, where the rotor blades are fastened via their blade roots in grooves which extend at least predominantly in the axial direction of the rotor base body, thus in axial grooves.

In the case of gas turbine rotors where the rotor blades are anchored via their blade roots in such axial grooves of the rotor base body, plate-type elements, namely securing elements (also referred to as locking plates), and locking elements (also referred to as retaining plates) are used to axially secure the rotor blades. When assembling such a gas turbine rotor, the locking elements, respectively the retaining plates, are threaded into annular grooves of the rotor base body, as well as of the rotor blades, to this end, at least one of the rotor blades being axially displaced to allow the locking elements to be inserted into the annular grooves. For their part, the locking elements are secured in position in the annular grooves via at least one securing element, respectively one locking plate, the or each securing element being deformed to fit engagingly in the annular grooves of the rotor base body, as well as of the rotor blades, into a free space between two adjacent locking elements.

When working with the related art securing elements, the problem arises that, once they are fitted into the annular grooves, they spring back and then no longer engage abuttingly on the rotor base body in a predetermined manner. This degrades the function of the securing elements.

SUMMARY OF THE INVENTION

The securing element according to the present invention has a plate-shaped base member, the base member having an approximately centrally disposed recess which is formed between two end sections of the base member and which defines a middle section of the base member that extends between the two end sections, the two end sections having mutually in parallel extending bearing surfaces.

Once the securing element according to the present invention is fittingly mounted in the annular grooves of the rotor base body and rotor blades, it is ensured that it engages abuttingly by bearing surfaces formed on the end sections of the base member of the securing element, in a planar manner or flat on the rotor base body. The securing elements according to the present invention permit a very defined and reproducible mounting of the same in the annular grooves of the rotor base body and rotor blades. As a result, full functionality of the securing elements is ensured.

BRIEF DESCRIPTION OF THE DRAWINGS

The present invention is described in greater detail in the following on the basis of exemplary embodiments, without being limited thereto. Reference is made to the drawing, whose figures show.

DETAILED DESCRIPTION

Prior to describing the present invention in greater detail with reference to FIG. 4 through 8, a gas turbine rotor known from the related art, having roots of rotor blades that are guided in grooves that extend at least predominantly in the axial direction—so-called axial grooves—will first be discussed with reference to FIG. 1 through 3.

Figure 1:
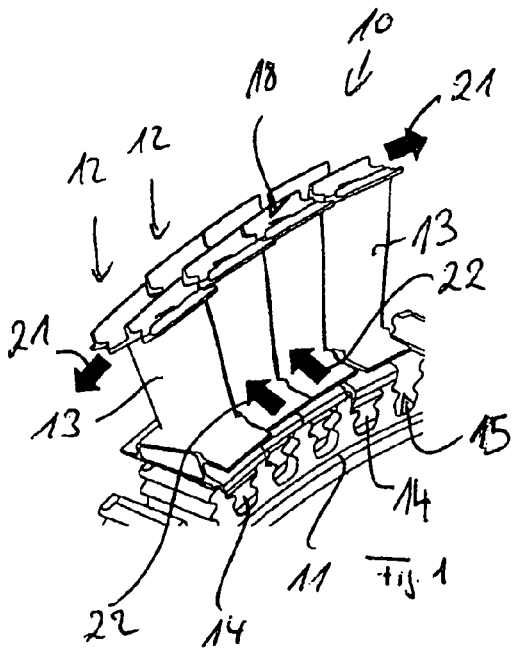
Fig. 1 (PRIOR ART)
FIG. 1: a detail of a related-art gas turbine rotor in a perspective side view.
Figure 2:
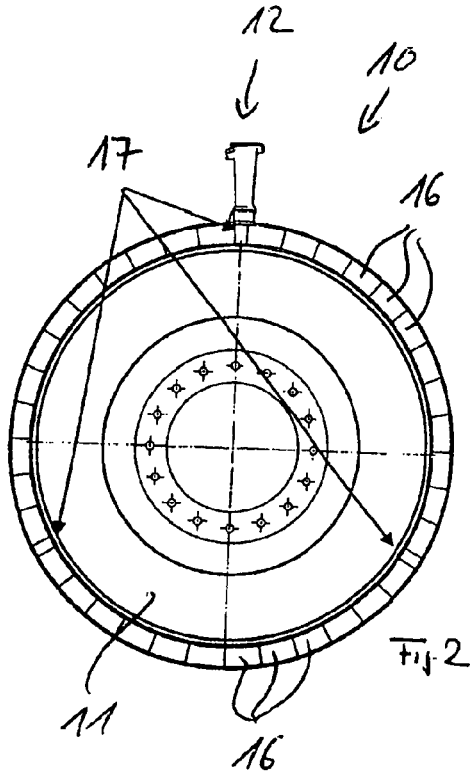
Fig. 2 (PRIOR ART)
FIG. 2 another detail of a related-art gas turbine rotor in a front view.
Figure 3A:
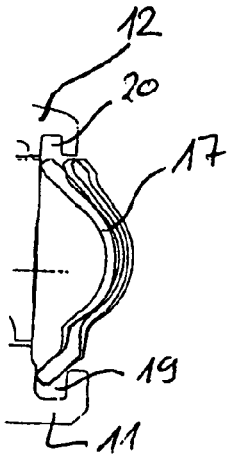
Fig. 3a (PRIOR ART)
FIG. 3*a*-3*b*: views for illustrating the related-art procedure for mounting securing elements in the context of a gas turbine rotor according to FIGS. 1 and 2.
Figure 3B:
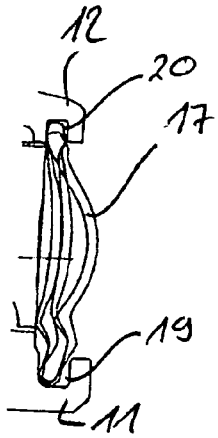
Fig. 3b (PRIOR ART)

FIGS. 1 and 2 show details of a gas turbine rotor 10 known from the related art that has a rotor base body 11, as well as a plurality of rotor blades 12. Each of rotor blades 12 has a blade 13, as well as a blade root 14. A plurality of axially extending axial grooves 15 are introduced into rotor base body 11, each rotor blade 12 being anchored by its blade root 14 in such an axial groove 15 in rotor base body 11. Locking elements 16 and securing elements 17 are used to axially fix in position, respectively axially secure rotor blades 12 that are inserted into axial grooves 15. Securing elements 17 are also referred to as locking plates; locking elements 16 as retaining plates. Rotor blades 12 are provided radially outwardly with segments of a shroud band 18, rotor blades 12 being joined to one another in the region of shroud band 18 by a "Z" interlock.

In the assembled state of gas turbine rotor 10, locking elements 16, as well as securing elements 17 are guided in annular grooves, namely in an annular groove 19 of rotor base body 11, as well as in an annular groove 20 of rotor blades 12.

To be able to introduce locking elements 16 into annular grooves 19 and 20 of rotor base body 11, as well as of rotor blade 12, as may be inferred, in particular, from FIG. 1, some of rotor blades 12 are canted circumferentially in the direction of arrows 21, allowing rotor blades 12 positioned therebetween to be axially displaced in the direction of arrows 22. In this manner, the axially displaced rotor blades interrupt annular groove 20 of the same, respectively clear annular groove 20, thereby allowing locking elements 16 to be inserted, respectively introduced into annular grooves 19 and 20. Once locking elements 16 have been threaded in, securing elements 17 are deformed to fit engagingly in annular grooves 19 and 20 in accordance with FIGS. 3*a* and 3*b* at selected circumferential positions (see FIG. 2), into a free space between adjacent, respectively circumferentially spaced apart locking elements 16, securing elements 17, that have been deformed to fit engagingly, bent back as far as possible following the fitting deformation and, in the process, being straightened out to the greatest degree possible. In this context, under related art methods, the problem arises that securing elements 17 do not rest flat against rotor base body 11, respectively blade roots 14. To overcome this problem, a novel securing element has been devised in accordance with the present invention.

Figure 4:
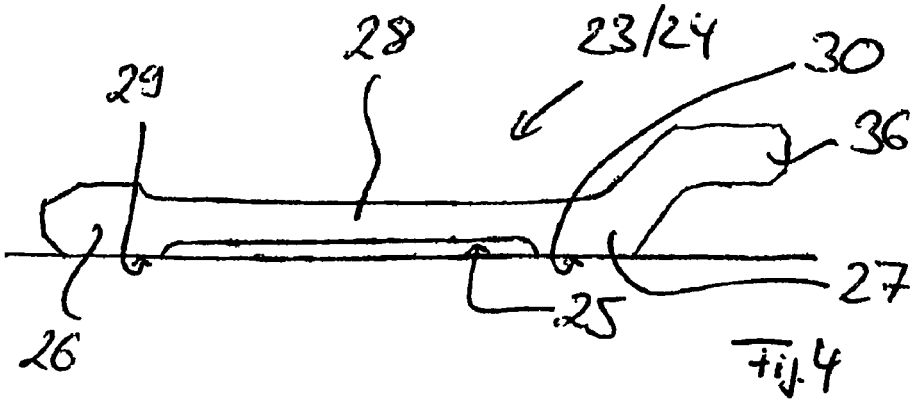
FIG. 4 a securing element according to the present invention in a lateral view.

FIG. 4 shows a securing element 23 according to the present invention for securing rotor blades 12 in position in axial grooves 15 of rotor base body 11 prior to the assembly of the same. Securing element 23 according to the present invention has a plate-shaped base member 24, base member 24 having an approximately centrally disposed recess 25. Recess 25 is formed between two end sections 26 and 27 of base member 24 and delimits a middle section 28 of the same. In the region of the two end sections 26 and 27, securing element 23 according to the present invention has mutually in parallel extending bearing surfaces 29 and 30. Prior to assembly, bearing surfaces 29 and 20 of the two end sections 26 and 27 are in alignment. Prior to assembly, middle section 28 is uncambered.

Figure 5:
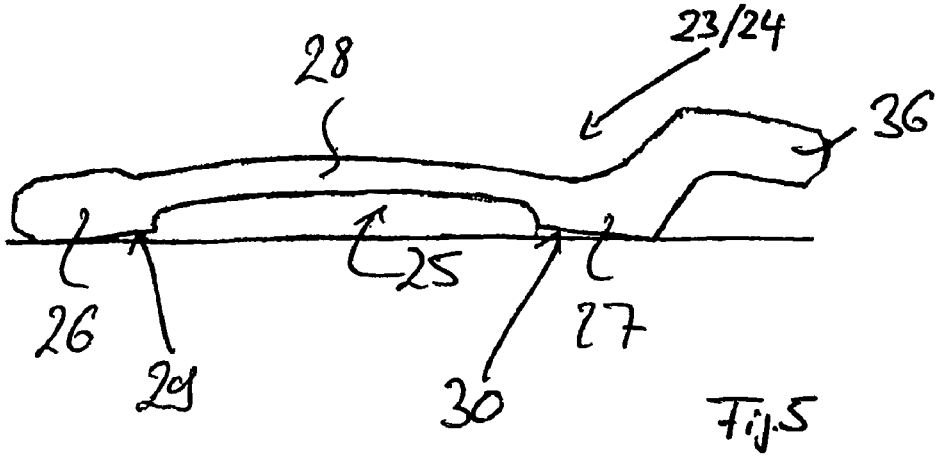
FIG. 5 the securing element according to the present invention in an intermediate position during assembly, namely following deformation of the same to fit into annular grooves of the rotor base body and rotor blades.
Figure 6:
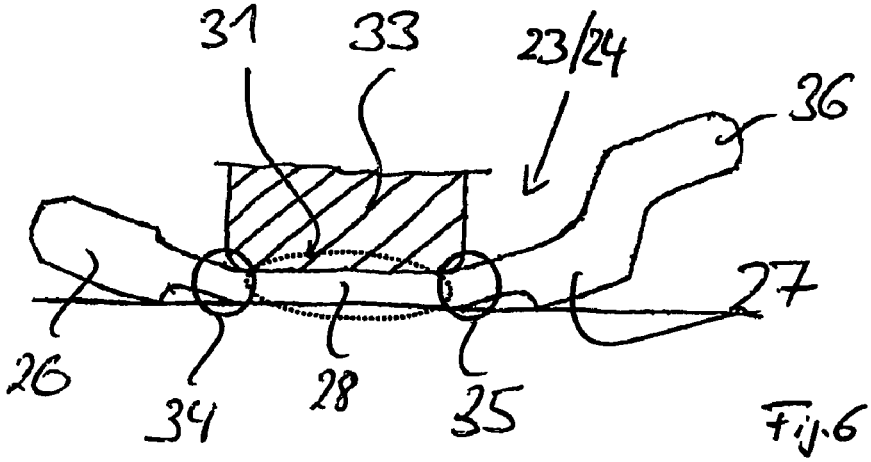
FIG. 6 the securing element according to the present invention in another intermediate position during assembly, together with a tool.
Figure 7:
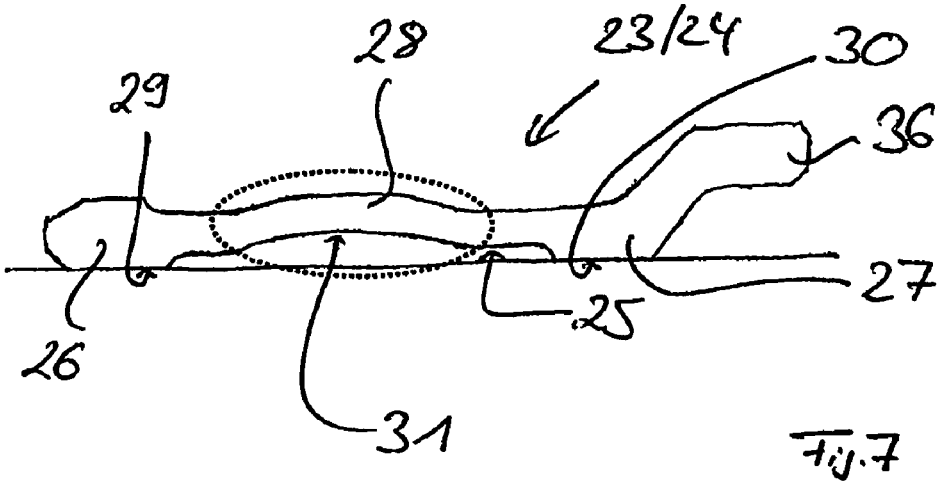
FIG. 7 the securing element according to the present invention in the installed position.
Figure 8:
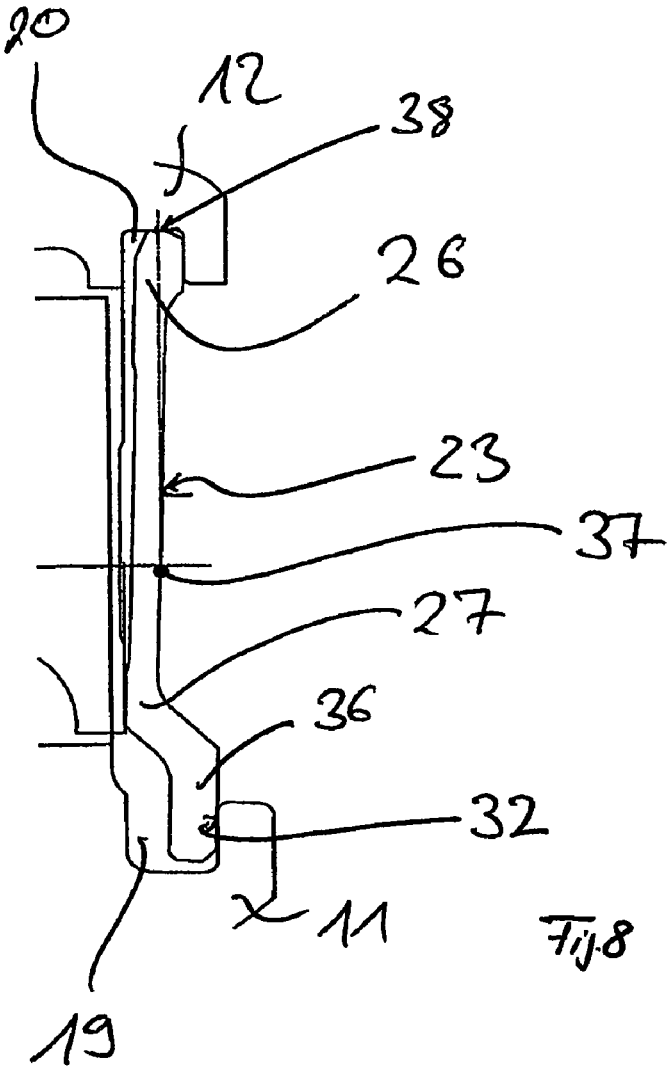
FIG. 8 the securing element according to the present invention in the installed position.

A securing element 23 of this kind in accordance with the present invention may undergo elastic and plastic deformation in order to fit engagingly in between annular grooves 19 and 20 of rotor base body 11, as well as of rotor blades 12; subsequently to its fitting deformation, securing element 23 assumes the position, respectively the shape shown in FIG. 5. Bearing surfaces 29 and 30 are cambered, as is middle section 28.

For the further assembly of securing element 23 according to the present invention, a ram-type tool 33 is pressed against middle section 28 of securing element 23, middle section 28, as well as ram-type tool 33 being dimensioned to act on securing element 23 exclusively in middle section 28, at a distance from end sections 26 and 27 thereof. Ram-type tool 33 bends securing element 23 in reverse, overbending it in middle section 28, so that, following removal of ram-type tool 33, securing element 23 assumes the position shown in FIG. 7. In the process, securing element 23 undergoes plastic deformation in middle section 28 in regions 34 and 35 where edge sections of ram-type tool 33 are effective, thereby forming portion 31 that has been subjected to extra bending stress shown in FIG. 7. Following removal of tool 33 and, thus, subsequently to the rebounding of securing element 23 that has been deformed to fit into, respectively that has been snapped into annular grooves 19 and 20 of rotor base body 11, as well as of rotor blades 12, bearing surfaces 29 and 30 of end sections 26 and 27 again extend mutually in parallel, and thereby realign after rebounding. Accordingly, subsequently to the rebounding of securing element 23, bearing surfaces 29 and 30 of end sections 26 and 27 again assume the position shown in FIG. 4. On the other hand, the already mentioned, cambered portion 31 that has been subjected to extra bending stress remains following removal of ram-type tool 33.

As may be inferred from FIG. 4 through 8, securing element 23 according to the present invention has a projection 36 in the region of end section 27. As may be inferred from FIG. 8, this projection 36 may be threaded into annular groove 19 of rotor base body 11 when the securing element according to the present invention is fitted engagingly into annular groove 19. In this context, projection 36 is dimensioned in such a way that a center-of-mass 37 of securing element 23 according to the present invention is displaced relative to a radial engagement 38 of end section 26 in the annular groove of blade root 12 in such a way that, during operation, centrifugal forces acting on securing element 23 press projection 36 against a sealing surface 32 in the region of annular groove 19 of rotor base body 11. An optimized sealing action is hereby provided for securing element 23 according to the present invention.

What is claimed is:

1. A securing element for securing rotor blades in position in grooves of a rotor base body of a turbine engine rotor, the grooves extending at least predominantly in the axial direction, the securing element comprising:

a plate-shaped base member, the base member having an approximately centrally disposed recess formed between two end sections of the base member so as to define a middle section of the base member extending between the two end sections, the two end sections having mutually in parallel extending bearing surfaces, wherein the middle section is dimensioned in such a way that, for the assembly operation, a ram-type tool is capable of acting exclusively on the securing element in the middle section at a distance from the two end sections thereof, thereby plastically deforming the middle section in regions where edge sections of the tool rest; and a projection formed in the region of an end section of the base member and, once the assembly operation has taken place, is disposed radially inwardly, and the projection determining a center-of-mass of the securing element in such a way that centrifugal forces acting during operation of the turbine engine rotor press the projection against a sealing surface.

2. The securing element as recited in claim 1 wherein, following assembly, the mutually in parallel extending bearing surfaces of the end sections face the rotor base body.

3. The securing element as recited in claim 1 wherein, prior to assembly, the middle section is approximately flat or uncambered, and, following assembly, the middle section has a cambered portion.

4. A method for mounting a securing element on a turbine engine rotor, for securing rotor blades in position in grooves of a rotor base body of the turbine engine rotor that extend at least predominantly in the axial direction, the method comprising:

fitting, in response to plastic and elastic deformation, the securing element of claim 1 into annular grooves of the rotor base body and of the rotor blades between two circumferentially spaced apart locking elements, by snapping in place or engagingly fitting end sections of the securing element into the annular grooves;

using a ram-shaped tool to overbend the middle section of the plate shaped base member to a predetermined degree, wherein the ram-type tool is pressed against the securing element exclusively in the middle section at a distance from the two end sections thereof, thereby plastically deforming the middle section in regions against which edge sections of the tool rest; and in a rebounding process, the securing element being subsequently straightened out and, when the ram-type tool is removed, the ends sections coming to rest engagingly in the annular grooves in a predetermined manner.

5. The method as recited in claim 4, wherein, following removal of the tool, the two end sections of the securing element extend approximately mutually in parallel, respectively in alignment.

6. The method as recited in claim 4 wherein following removal of the tool, the middle section has a cambered portion.

7. A rotor of a turbine engine comprising:

a rotor base body, the rotor base body having a plurality of axial grooves extending at least predominantly in the axial direction or in a direction of flow;

a plurality of rotor blades, each rotor blade being anchored via a blade root in an axial groove of the rotor base body, and, before being axially displaced, the rotor blades being secured in their anchoring position in the rotor base body by securing elements and locking elements guided in annular grooves of the rotor base body and of the rotor blades;

the securing elements as recited in claim 1 being positioned in the annular grooves.

8. The rotor as recited in claim 7 wherein the rotor is a gas turbine rotor.

* * * * *